US005937873A

United States Patent [19]

Schlosser et al.

[11] Patent Number: 5,937,873

[45] Date of Patent: Aug. 17, 1999

[54] DEVICE FOR APPLYING A COSMETIC PRODUCT

[75] Inventors: Michael Schlosser; Joseph Segal, both of I.M.S. Cosmetics 4 B Freud St., P.O.B. 33 594, Haifa, Israel; Georg Roeder, Schwabach, Germany

[73] Assignees: Michael Schlosser; Joseph Segal, both of Haifa, Israel

[21] Appl. No.: 08/919,677

[22] Filed: Aug. 28, 1997

[30] Foreign Application Priority Data

Sep. 2, 1996 [DE] Germany ..... 196 35 584

[51] Int. Cl.[6] ..... A45D 40/26

[52] U.S. Cl. ..... 132/320; 132/317; 401/132; 401/130; 401/183

[58] Field of Search ..... 132/320, 218, 132/317, 216; 401/132, 183, 130, 196, 6, 25, 207; 15/210.1, 144.4, 184, 244.1, 144.3, 145; 604/1, 2, 3, 305, 306, 294; 206/581, 823

[56] References Cited

U.S. PATENT DOCUMENTS

| | | | |
|---|---|---|---|
| 2,778,045 | 1/1957 | Bly et al. | 401/132 |
| 2,961,677 | 11/1960 | Zecchini | 401/183 |
| 3,039,132 | 6/1962 | Hambley . | |
| 3,299,464 | 1/1967 | O'Brien et al. | 401/130 |
| 3,321,790 | 5/1967 | Hand | 401/183 |
| 3,896,725 | 7/1975 | Grover . | |
| 4,183,684 | 1/1980 | Avery, Jr. | 401/132 |
| 4,360,020 | 11/1982 | Hitchcock, Jr. et al. | 401/132 |
| 4,757,761 | 7/1988 | Holland . | |
| 4,831,676 | 5/1989 | Denmark | 15/210.1 |
| 4,869,612 | 9/1989 | Mooney et al. . | |
| 5,137,038 | 8/1992 | Kingsford . | |
| 5,743,279 | 4/1998 | Gueret | 132/218 |

FOREIGN PATENT DOCUMENTS

| | | | |
|---|---|---|---|
| 437042 | 7/1991 | European Pat. Off. . | |
| 985064 | 7/1951 | France . | |
| 148981 | 10/1902 | Germany . | |
| 1107627 | 10/1957 | Germany . | |
| 529161 | 9/1959 | Germany . | |
| 541773 | 12/1981 | Germany . | |
| 8503447 | 8/1985 | Germany | 132/320 |
| 257034 | 6/1988 | Germany . | |
| 737248 | 5/1980 | U.S.S.R. . | |

OTHER PUBLICATIONS

Patent No. 883 913—June. 11, 1953—Germany.
Patent No. 0 097 502—Jan. 4, 1984—EPC.

*Primary Examiner*—Gene Mancene
*Assistant Examiner*—Pedro Philogene
*Attorney, Agent, or Firm*—Bachman & Lapointe, P.C.

[57] ABSTRACT

Described is a device for applying a powdery, pasty, gel-like or liquid cosmetic product to skin or hair. The application device comprises at least one application element which is used to hold the cosmetic product and release it onto the skin or hair upon touching the skin or hair. According to the invention, the application element is elongated and extends along an at least partially convex circumferential line of the device.

22 Claims, 4 Drawing Sheets

DEVICE FOR APPLYING A COSMETIC PRODUCT

BACKGROUND OF THE INVENTION

The invention relates to a device for applying a powdery, pasty, gel-like or liquid cosmetic product to skin or hair, with at least one application element used to hold the cosmetic product and release it onto the skin or hair upon touching the skin or hair.

Application devices of the type mentioned above, for example for applying cosmetics products to the eyelids, are well known. The known application devices are usually designed in the shape of a pen, i.e. they comprise an elongated shaft at the tip of which there is the application element.

If a cosmetic product is to be applied in the shape of a straight line, such as an eye-liner, the pen must be guided in a straight line. Unfortunately, however, it is extremely difficult to draw a straight line without rulers or similar. In particular, an eye-liner poses the problem of the eyelid being curved over the eye and thus having an arched shape. To draw a straight line with a pen on such an arched shape can only be done with a steady hand and a lot of experience. If one wishes to draw a straight line with such a pen, one is confronted with a dilemma: if one holds the pen very far down, i.e. near the application element, one has to guide the hand in a straight line according to the desired straight line; a difficult task. But if one holds the pen further up, then, due to the given angles and levers, any unsteadiness of the hand is transferred in an exaggerated way to the line being drawn.

Accordingly it is the principle object of the invention to improve the application device of the type mentioned above in such a way that it allows for easy application of a cosmetic product in a line having the desired shape.

SUMMARY OF THE INVENTION

According to the present invention, the foregoing object is achieved wherein the application element is elongated and extends along an at least partially convex circumferential line of the device.

Since the application element, in contrast to the rather pointed tips of traditional application devices, is elongated and is at least in some sections convex in shape, the application device, when applying the cosmetic product, need not be drawn across the skin along the desired straight line, but rather, the cosmetic product can be applied to the skin or hair by "rolling" the application element over the skin or hair. In other words, the application device according to the invention functions in the manner of a "stamp" whose stamp surface is curved, so that "stamping" takes place through a rolling action. In order to create a straight line, one merely needs to take care, during application, to avoid swivelling the application device around an axis perpendicular to the skin or the hair. If no such swivelling takes place, the line created will always be absolutely straight.

During "rolling", the application device according to the invention can be held very far down, i.e. near the application element, without this rendering it more difficult to draw a straight line. Any unsteadiness thus has no negative effect.

Because with the application device according to the invention, during application, a relatively large surface rests against the skin, in comparison with a pen with application tip, any unevenness and wrinkles in the skin can be compensated for, or evened out, by pressure. Therefore it is not necessary to tension the skin at the time of application. For the same reason it also obviates the need to close the eye if a cosmetic product is to be applied to the upper or lower eyelid. Consequently, "squinting", considered unpleasant by many users, is no longer necessary.

Some known application devices have a point which, prior to the application process, is immersed in a reservoir containing the cosmetic product. If one draws a line with such a tip, the tip at first is necessarily relatively wide or strong, because at first there is still a relatively large quantity of the cosmetic product present at the tip. During drawing of the line, however, the quantity of the cosmetic product at the tip of the application device decreases, rendering the line progressively thinner and weaker.

By contrast, with the application device according to the invention, during application of the cosmetic product, each part of the application element comes in contact only with a respective part of the skin or the hair, which is why the previously described "exhaustion" of the application element cannot occur. Instead, the applied line is even.

Moreover, in the case of the application device according to the invention, the line thickness directly depends on the pressure applied, which is why it can be controlled by means of controlling the respective pressure applied.

As already mentioned above, in the case of the traditional application device, the line thickness progressively decreases with increasing line length. If one has completed the first part of the line and is then compelled to load the applicator tip of the application device anew with the cosmetic product, then after re-positioning the tip, the line will unavoidably have a different thickness, resulting in an altogether irregular look. By contrast, the application device according to the invention can be withdrawn after part of the line has been completed and positioned anew, without any resulting irregularities in the transitional area.

The width of the application element can be constant over its entire length. But it can also change over the length of the application element, for example it can gradually increase or gradually decrease, be stepped or similar.

While the application element can have a straight shape in horizontal projection, it can also, in its horizontal projection, deviate, at least in some sections, from a straight line. It can for example be curved, progress in a serpentine line or meander. The above creations, referring to a "straight" line of the line applied with the application element, are to be understood in this sense also. Therefore, in this connection, the term "straight" means that the line is not to deviate from the shape desired by the user.

According to one embodiment of the invention, the application element comprises embellishment motives, i.e. negatives of symbols or similar to be applied to the skin or hair by means of the application device.

According to a preferred embodiment of the invention, the length of the application element, the width of the application element and/or the shape of the circumferential line of the device are adjustable in horizontal projection. Therefore, by the respective choice of the parameters mentioned, lines of the most varied shapes can be achieved.

In preference, the application device according to the invention has two or more application elements. These application elements may then for example be used to apply lines of different colour.

According to a further preferred embodiment of the invention, the application elements differ in length, width and/or shape of the circumferential line in horizontal projection of the application element. This allows not only the application of lines of various colours but also lines of various shapes.

In principle, the application device can be any shape. Preferably it is round, oval, kidney-shaped, heart-shaped or T-shaped in horizontal projection.

The same applies to the cross-section of the application device according to the invention. It too can be any shape. Preferably, however, it is essentially rectangular or essentially wedge-shaped whereby the application element, of which there is at least one, is located in the area of the tip of the wedge.

As already mentioned, traditional application devices may require that they be held at a certain distance of the actual application element, in order to draw a line of the desired shape.

Since according to the invention, this distance from the application element is not required, according to the invention it is preferred that the application device comprise a holding area, adjacent to the application element, for holding the device in the hand. This embodiment is based on the recognition that the closer the holding area of the device is to the application element, the less chance there is that handling the device is influenced by any unsteadiness.

In this, the holding area may comprise at least one holding indenture.

Replenishing the application device can in principle take place in whatever manner. However, according to a preferred embodiment, the application device comprises a reservoir for a liquid cosmetic product which reservoir is connected to the application element by means of a channel.

In order to thereby automate replenishing of the application element, at least one of the channels is preferably a capillary channel.

In this, a covering device may be provided for covering the application element in such a way that drying out is prevented.

Alternatively, the invention provides a reservoir for at least one cosmetic product, with an insertion aperture for inserting the application device according to the invention in such a way that the application element, in the inserted position, is loaded with the cosmetic product contained in the reservoir. This embodiment is suitable for all types of cosmetic products.

In this, the insertion aperture is preferably designed in such a way that the application device, in its inserted state, closes it so as to prevent drying out of the cosmetic product. In other words, the application device at the same time represents a closing device for the reservoir which device closes the reservoir at least when the application device is inserted into the insertion aperture.

According to a particularly preferred embodiment of the invention, a closing device is provided at the insertion aperture, with the said closing device opening automatically when the application device is inserted into the reservoir, and closing automatically when the application device is withdrawn from the reservoir. This is to prevent drying out of the cosmetic product in the reservoir. This closing device for closing the reservoir when the application device is withdrawn therefore represents a counterpart to closing with the application device inserted.

Preferably, the said closing device is formed by lamellae pre-tensioned in the direction of closure.

The invention also creates a reservoir for at least one liquid cosmetic product for replenishing the application element—of which there is at least one—of the application device according to the invention, whereby according to the invention, the said reservoir comprises at least one capillary storage device. This capillary storage device may for example be a stamp pad, a sponge or similar.

Preferably, the reservoir comprises a lid which in its closed position prevents drying out of the cosmetic product in the capillary storage device.

Finally, the invention creates a holding device for simultaneously holding at least one application device according to the invention and at least one reservoir for the cosmetic product.

In this, the reservoir, of which there is at least one, can be a reservoir with a capillary storage device. A cover may also be provided.

In this, it is particularly preferable that the application device, of which there is at least one, is contained in the lid.

BRIEF DESCRIPTION OF THE DRAWINGS

Below, the invention is illustrated in more detail by means of preferred embodiments, with reference to the drawings, as follows.

DETAILED DESCRIPTION

FIGS. 1 to 4 show various embodiments of the application device 10 according to the invention. They comprise two application elements 12 and 14 each. Of course they may also comprise one application element only, or more than two application elements.

Figure 1:
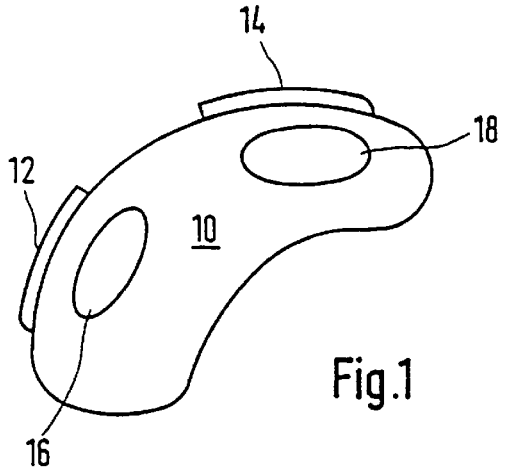
FIGS. 1 to 4 show horizontal projections of various embodiments of the application device according to the invention.
Figure 2:
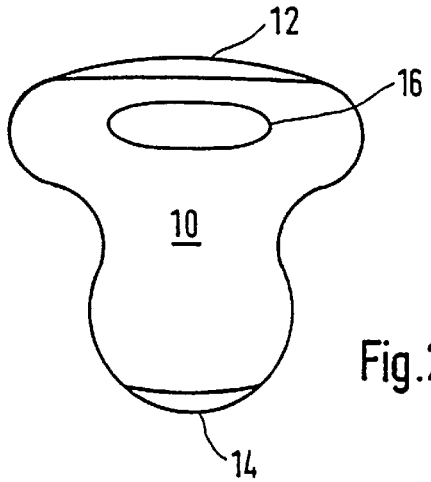
Figure 3:
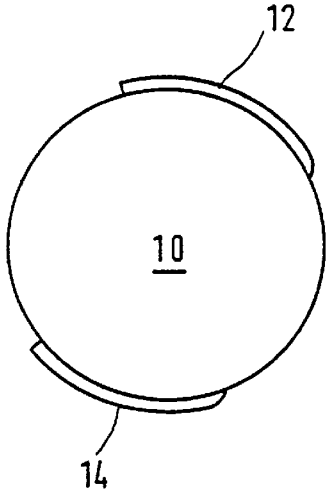
Figure 4:
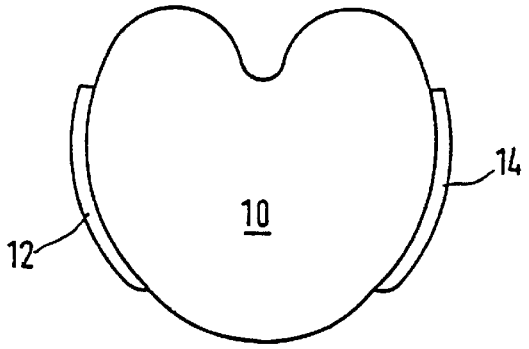
Figure 5:
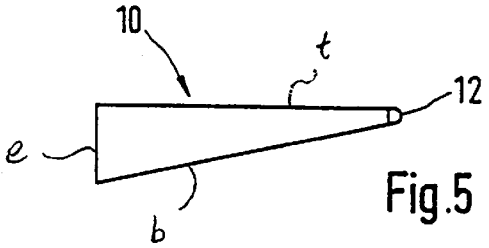
FIGS. 5 to 7 show sectional views of various embodiments of the application device according to the invention.
Figure 6:
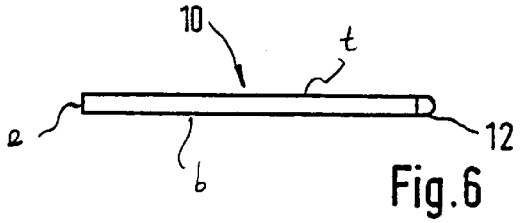
Figure 7:
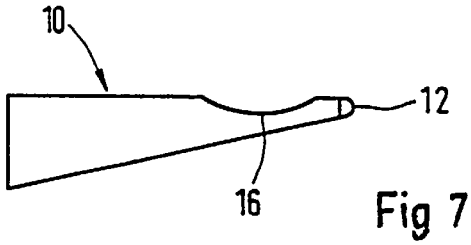
Figure 8:
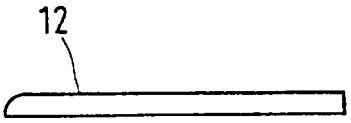
FIGS. 8 to 11 show horizontal projections of various embodiments of application elements.
Figure 9:
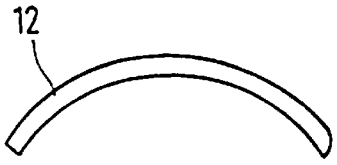
Figure 10:
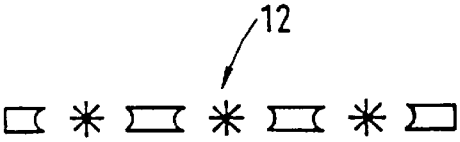

As shown in the representations according to FIGS. 5 to 7, the application device according to the invention may have a rectangular or wedge-shaped cross-section having a top surface (t), a bottom surface (b) and an edge surface (e) therebetween, whereby in particular FIG. 7 shows the arrangement of a holding indenture 16, near the point of the wedge, whereby the point of the wedge comprises at least one application element 12. In this, the following applies: the thinner the application device, the smaller the risk of the application device itself blocking the view during the application of make-up.

Figure 11:
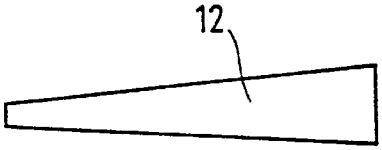

FIGS. 8 to 11 show horizontal projections of the application element. According to FIG. 8 it can be designed in constant width and in a straight line layout. According to FIG. 9 it is curved, resulting in a respective curved line-layout. FIG. 11 shows a design in which the line thickness increases as the line progresses. According to FIG. 10, embellishment elements in the shape of stars are provided. These embellishment elements can occur singly; but they can also be provided in combination with the lines according to FIGS. 8, 9 and 11. Of course, symbols other than stars can be achieved too; for example flowers, geometric shapes and similar are imaginable.

Figure 12:
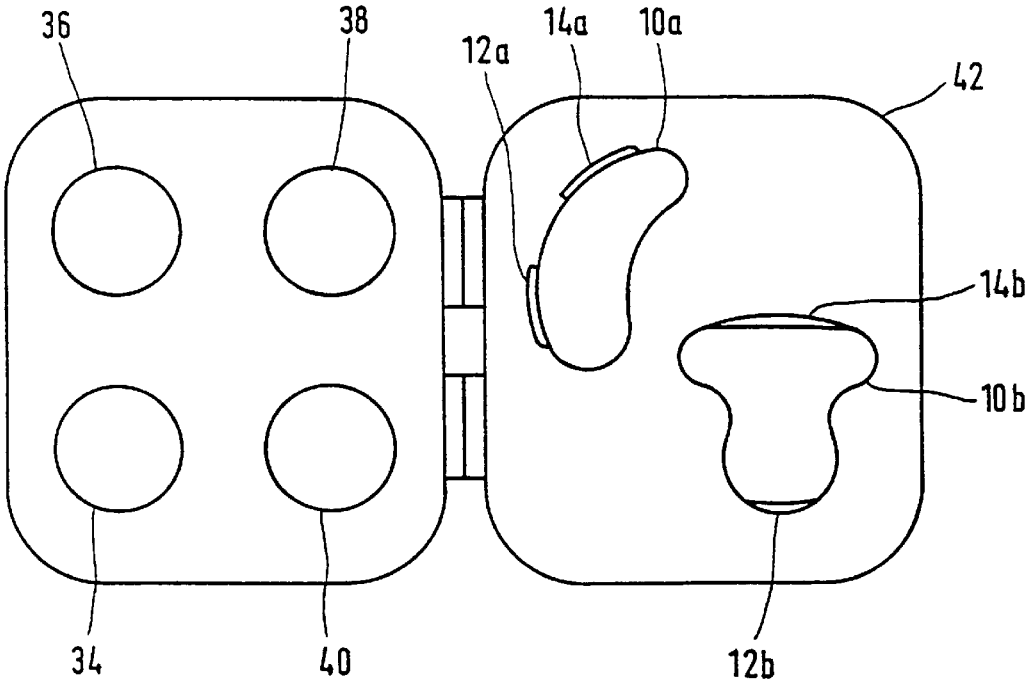
FIG. 12 shows a holding device for cosmetic product reservoirs on the one hand, and application devices on the other hand.

FIG. 12 shows a holding device, in the shape of a folding-case, according to one embodiment of the invention. On the left side as shown in FIG. 12, "stamp pads" 34, 36, 38 and 40 are provided which are moistened with liquid cosmetic products of various colours, for example the colours red, green, blue and black.

On the right side which serves as a lid 42, two differently shaped application devices 10*a* and 10*b* are provided on the holding device; the said application devices 10*a* and 10*b* may for example create lines of various shapes or may be used only with particular colours. In the embodiment shown, the two application devices 10*a* and 10*b* have two application elements 12*a* and 12*b*, or 14*a* and 14*b*, so that there are four different application elements for four different colours.

The application elements can for example be felt strips or similar which are attached in a suitable way to the rim of the application device 10, for example by a clamp-type holder.

However, the application device 10 can also comprise a material suitable for holding the respective cosmetic product, for example rubber. In such a case, the felt strips are not necessary, but rather the rim of the rubber structure itself represents the application element.

The holding indentures can be positioned on one side only, as shown in FIG. 7, but they can also be provided on both sides.

Figure 13:
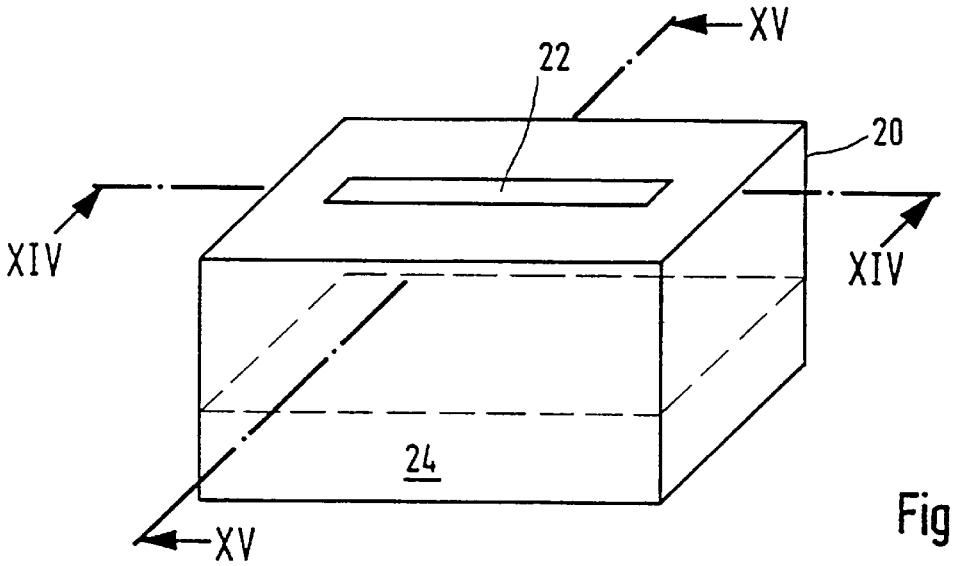
FIG. 13 shows a diagrammatic perspective view of a further embodiment of a reservoir.

FIG. 13 shows a reservoir for a liquid cosmetic product. The reservoir overall carries the reference 20. It comprises a slot-shaped insertion aperture 22 into which the disc-shaped application device 10 fits, in order to come into contact, in the reservoir 20, with a liquid cosmetic product 24. The slot 22 and the application device 10 must be matched to such an extent that the application device 10 can be moved within the slot 22 in such a way that the application elements 12 and 14 are completely moistened even when the liquid level is low.

Figure 14:
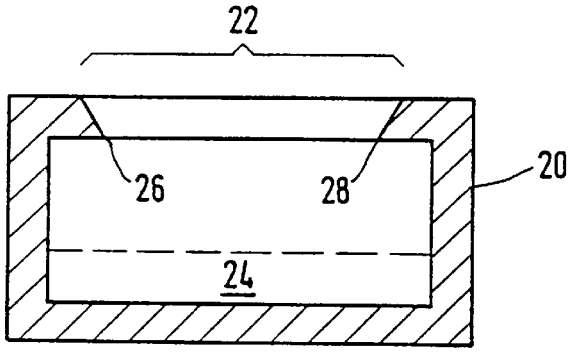
FIG. 14 shows a sectional view along the line XIV—XIV in FIG. 13.

According to FIG. 14, the slot 22, at its two extremities, comprises wipers 26 and 28, formed by bevelled areas. When withdrawing the application device 10 from the reservoir 20, the application device is turned in such a way that an application element 12 or 14 brushes against one of the wipers 26 or 28 so that the cosmetic product adhering to the application element 12 or 14 is distributed more evenly. For this, the wiper on the one hand, and the application element on the other hand, need to be matched to each other. For example, the wiper may comprise a relatively hard material, i.e. for example part of the wall of the reservoir 20, if the application element comprises a relatively soft material, such as for example felt. If on the other hand, the application material is relatively hard, for example made of rubber, then the wiper should be relatively soft, i.e. it should for example be covered by felt or similar. For, if a relatively hard surface of an application element would brush against an also relatively hard wiper, then the cosmetic product might be completely removed from the application element, so that the said application element would no longer be holding any of the cosmetic product.

Figure 15:
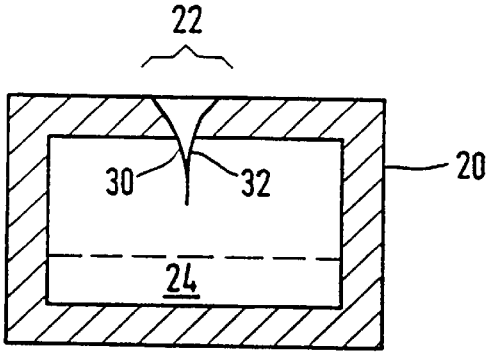
FIG. 15 shows a sectional view along the line XV—XV in FIG. 13.

According to FIG. 15, on both sides of the slot 22 there are lamellae 30 or 32 which are elastically pretensioned against each other. When inserting the application device 10 they open up into the insertion aperture 22, so that the application device or the application elements 12 or 14 are moistened with some of the cosmetic product 24 contained in the reservoir. If however the application device 10 is removed from the reservoir 20, then the lamellae 30 and 32, due to their elastic pre-tension in the direction of closure, close the insertion aperture 22, so that drying out is reliably prevented.

But with the application device inserted, too, the lamellae 30 and 32 fit snugly to the application device so that in this case also, the reservoir is closed in such a way as to prevent drying out of the cosmetic product.

Figure 16:
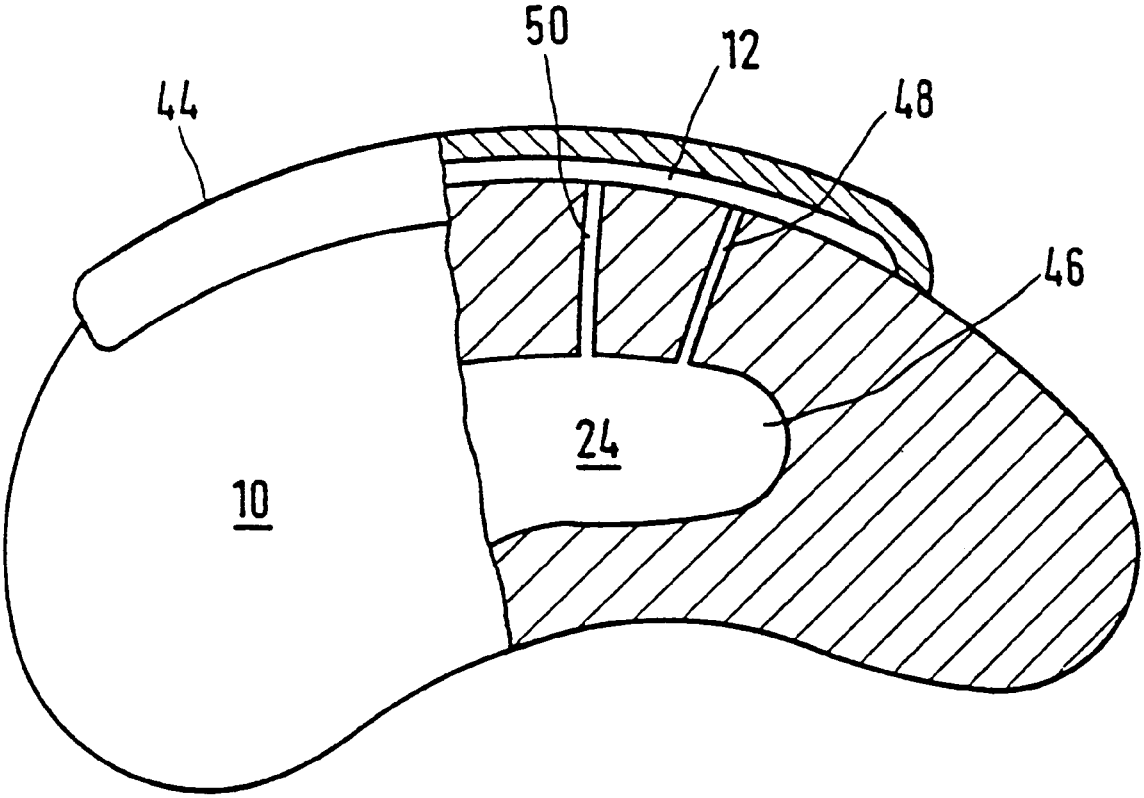
FIG. 16 shows a partially cut horizontal projection of a further embodiment of the application device according to the invention.

FIG. 16 shows a horizontal projection, cut on the right, of a further embodiment of the application device according to the invention. A cap 44 can be placed over the application element 12 of the application device 10, so as to prevent drying out. The application element 12 is supplied with the liquid cosmetic product 24 by way of a tank 46 connected to the application element 12 by way of several capillary channels 48, 50. By way of the capillary channels 48 and 50, replenishing of the application element 12 with the cosmetic product 24 takes place automatically, as a result of the capillary effect.

The characteristics of the invention, which were disclosed in the above description, in the claims and in the drawing, may be essential both individually and in any combination, for realising the invention in its various embodiments.

We claim:

1. A device for applying a cosmetic product comprising: an application device having a top surface, a bottom surface and an edge surface there between; and at least one elongated application element extending along said edge surface between said top surface and said bottom surface and forming an at least partially convex circumferential surface for application of the cosmetic product.

2. A device according to claim 1 including a plurality of elongated application elements extending along said edge surface.

3. A device according to claim 2 wherein each of said plurality of elongated application elements differ in size and shape from the others.

4. A device according to claim 1 wherein at least one of said top surface and said bottom surface is provided with a holding indenture.

5. A device according to claim 1 wherein the application element is provided with a width which is constant over the application element length.

6. A device according to claim 1 wherein the application element is provided with a width which changes over the application element length.

7. A device according to claim 1 wherein the application element has a straight shape in horizontal projection.

8. A device according to claim 1 wherein the shape of the application device in horizontal projection is selected from the group consisting of round, oval, kidney-shaped, heart-shaped and T-shaped.

9. A device according to claim 1 wherein the shape of the application device in cross-section is essentially rectangular.

10. A device according to claim 1 wherein the shape of the application device in cross-section is essentially wedge-shaped and forms a trip, whereby the application element is located in the area of the tip of the wedge.

11. A device according to claim 4 wherein the holding indenture is adjacent to the application element.

12. A device according to claim 1 wherein the application device includes a reservoir for a liquid cosmetic product, said reservoir is connected to the application element by means of at least one channel.

13. A device according to claim 12 wherein the at least one channel is a capillary channel.

14. A device according to claim 12 including a covering device for covering the application element to prevent drying out.

15. A device according to claim 1 further including a reservoir for receiving at least the at least one elongated application element of the application device, said reservoir having a cosmetic product contacted by said application element.

16. A device according to claim 15 wherein the reservoir is provided with an insertion aperture for receiving the application device in such a way that drying out of the cosmetic product is prevented.

17. A device according to claim 16 wherein the insertion aperture includes a wiping device for evening out the cosmetic product during withdrawal of the application element from the reservoir.

18. A device according to claim 16 including a closing device associated with the insertion aperture wherein the closing device opens automatically when the application device is inserted into the reservoir and closes automatically when the application device is withdrawn from the reservoir.

19. A device according to claim 18 wherein the closing device is formed by lamellae pre-tensioned in the direction of closure.

20. A device according to claim 1 further including a reservoir having cosmetic product for replenishing the at least one application element.

21. A device according to claim 20 wherein the reservoir includes a lid which, in its closed position, prevents drying out of the cosmetic product in the reservoir.

22. A device according to claim 21 wherein the lid of the reservoir further includes means for holding the application device.

* * * * *

UNITED STATES PATENT AND TRADEMARK OFFICE

CERTIFICATE OF CORRECTION

PATENT NO. : 5,937,873

DATED : August 17, 1999

INVENTOR(S) : Michael Schlosser et al.

It is certified that error appears in the above-identified patent and that said Letters Patent is hereby corrected as shown below:

In claim 10, line 60 of column 6, "trip" should be corrected to read --tip--.

Signed and Sealed this

Eleventh Day of July, 2000

*Attest:*

Q. TODD DICKINSON

*Attesting Officer*

*Director of Patents and Trademarks*